US007527448B2

(12) United States Patent
Ono et al.

(10) Patent No.: US 7,527,448 B2
(45) Date of Patent: May 5, 2009

(54) WRITING IMPLEMENT WITH CLIP

(75) Inventors: Toshihiro Ono, Isesaki (JP); Masahiro Kogure, Takasaki (JP); Norio Moriyama, Fukaya (JP)

(73) Assignee: Kabushiki Kaisha Pilot Corporation, Tokyo-To (JP)

( * ) Notice: Subject to any disclaimer, the term of this patent is extended or adjusted under 35 U.S.C. 154(b) by 0 days.

(21) Appl. No.: 11/793,004

(22) PCT Filed: Dec. 27, 2005

(86) PCT No.: PCT/JP2005/023936

§ 371 (c)(1),
(2), (4) Date: Jun. 14, 2007

(87) PCT Pub. No.: WO2006/070821

PCT Pub. Date: Jul. 6, 2006

(65) Prior Publication Data

US 2008/0112749 A1 May 15, 2008

(30) Foreign Application Priority Data

Dec. 28, 2004 (JP) ..... 2004-380371
Sep. 5, 2005 (JP) ..... 2005-256891

(51) Int. Cl.
*B43K 23/02* (2006.01)

(52) U.S. Cl. ..... 401/131; 24/11 M; 24/11 R

(58) Field of Classification Search ..... 401/131, 401/195; 24/11 R, 11 P, 11 M
See application file for complete search history.

(56) References Cited

U.S. PATENT DOCUMENTS 3,146,758 A * 9/1964 Zepell ..... 401/106

(Continued)

FOREIGN PATENT DOCUMENTS

JP 55-148990 11/1980

(Continued)

OTHER PUBLICATIONS

International Preliminary Report on Patentability and Written Opinion of the International Searching Authority issued Jul. 3, 2007 in International (PCT) Application No. PCT/JP2005/023936 of which the present application is the U.S. National Stage.

*Primary Examiner*—David J Walczak
(74) *Attorney, Agent, or Firm*—Wenderoth, Lind & Ponack, L.L.P.

(57) ABSTRACT

A writing implement provided with a strong clip is simple in construction and is provided with a coil spring restrained from easily falling off. The writing implement (1, 11, 21) includes a tubular body (2), a clip (3), a pillar (7) formed on the outer surface of the tubular body, a connecting structure R connecting the clip and the pillar, a coil spring (4) extended between the inner surface of the clip and the tubular body and capable of loading the clip such that a front end part (3*aa*) of the inner surface of the clip is pressed elastically against the outer surface of the tubular body, and a projection (5) formed on the outer surface of the tubular body so as to project toward the clip and fitted in the coil spring. Preferably, the clip is provided with a back wall (10) projecting from a back part (3*ab*) of the inner surface (3*a*) of the clip and the coil spring is disposed on the front side of the back wall. The projection (5) has a height not smaller than half the length of the coil spring.

17 Claims, 10 Drawing Sheets

U.S. PATENT DOCUMENTS

| | | | | |
|---|---|---|---|---|
| 4,573,818 | A * | 3/1986 | Kodera | 401/131 |
| 6,499,196 | B1 * | 12/2002 | Mittersinker et al. | 24/11 R |
| 6,659,673 | B1 * | 12/2003 | Haffner et al. | 401/258 |
| 6,685,374 | B1 * | 2/2004 | Cetera | 401/131 |
| 2004/0096262 | A1 * | 5/2004 | Isoda et al. | 401/131 |
| 2005/0163555 | A1 * | 7/2005 | Cetera | 401/131 |

FOREIGN PATENT DOCUMENTS

| | | |
|---|---|---|
| JP | 56-159283 | 12/1981 |
| JP | 07-172093 | 7/1995 |
| JP | 2001-146094 | 5/2001 |

* cited by examiner

WRITING IMPLEMENT WITH CLIP

TECHNICAL FIELD

The present invention relates to a writing implement with a clip and, more specifically, to a writing implement including a barrel and provided with a clip continuously elastically loaded such that the inner surface of a front end part thereof is pressed against the outer surface of the barrel and can be separated from the outer surface of the barrel.

BACKGROUND ART

There is a generally known writing implement having a barrel and provided with a clip. The clip is continuously elastically loaded such that the inner surface of a front end part thereof is pressed against the outer surface of the barrel and the front end part can be separated from the barrel by pressing a back end part thereof. A clip mechanism for a writing implement disclosed in JP 55-148990 U (Patent document 1) and a clip mechanism for a writing implement disclosed in JP 56-159283 U (Patent document 2) use a coil spring as an elastic member for loading a clip.

JP 55-148990 U (Patent document 1)

JP 56-159283 U (Patent document 2)

SUMMARY OF THE INVENTION

The coil spring of the writing implement is warped when the clip is turned. A cylindrical recess is formed in the barrel or a cap and an end part of the coil spring is fitted in the cylindrical recess to prevent the coil spring from easily coming off the barrel or the clip when the coil spring is warped.

The cylindrical recess needs to be formed in a depth sufficient for surely restraining the coil spring from easily coming off the cylindrical recess. Consequently, the wall of the barrel needs to have a large thickness and the clip needs to be formed in a large thickness, and thus the cost of the writing implement increases and the degree of freedom of design is reduced. The coil spring of the known writing implement may be inserted into the interior of the barrel to hold the coil spring on the barrel, which, however, complicates the construction of the writing implement and assembling work for assembling the writing implement and requires a space for receiving the coil spring.

A means for preventing the coil spring from falling off the writing implement includes side walls formed in a back end part of a clip so that the back end part has a substantially U-shaped cross section. However, the side walls of the back end part of the clip cannot perfectly prevent the coil spring from falling off.

When the clip having the back end part having the side walls is operated to separate the inner surface of the front end part thereof from the barrel, the coil spring is warped convex toward the front end of the clip as shown in FIG. 2. Consequently, the coil spring separates from the side walls and, in some cases, the coil spring separates from a part on the side of the front or the back end of the barrel.

When a clip provided with only side walls formed in a back end part thereof is turned on the joint of the clip and the barrel to separate the inner surface of the front end part of the clip from the barrel, end surfaces of the side walls facing the barrel come into contact with the outer surface of the barrel to limit the turning of the clip. In some cases, an excessive force is applied to the back end part of the clip in the direction of the arrow F1 as shown in FIG. 2 after the end surfaces of the side walls of the clip have come into contact with the barrel. When the side walls are formed simply in the back end part of the clip so that the back end part has a substantially U-shaped cross section, the side walls are likely to be bent or broken when an excessively high pressure is applied to the clip, the clip is repeatedly operated or a shock is exerted on the clip.

Accordingly, it is an object of the present invention to provide a writing implement simple in construction, easy to assemble and provided with a highly strong clip capable of preventing a coil spring from easily coming off the clip.

The present invention provides a writing implement including: a tubular body; a clip; a pillar formed on the outer surface of the tubular body; a connecting structure connecting the clip and the pillar; a coil spring extended between the inner surface of the clip and the tubular body and capable of loading the clip such that a front end part of the inner surface of the clip is pressed elastically against the outer surface of the tubular body and of permitting the clip to be turned on the connecting structure so that the front end part of the inner surface of the clip is separated from the barrel when a back end part of the clip is pressed toward the tubular body; and a projection formed on the outer surface of the tubular body at a position behind the pillar so as to project from the outer surface of the tubular body toward the clip.

In the writing implement according to the present invention, the clip may be provided with a back wall inside a back part thereof and the coil spring may be disposed on the front side of the back wall.

In the writing implement according to the present invention, the projection may have a height not smaller than half the length of the coil spring in a state for loading the clip to keep the front end part of the inner surface of the clip in contact with the barrel.

In the writing implement according to the present invention, the clip may be provided with side walls in a back part thereof, and the coil spring may be disposed between the side walls.

In the writing implement according to the present invention, the connecting structure may have projections formed in the pillar (or the side walls) and recesses formed in the side walls (or the pillar) so as to receive the projections, respectively.

In the writing implement according to the present invention, the back wall may be provided with a slit.

In the writing implement according to the present invention, the back wall may have the shape of a thin plate having a thickness parallel to the length of the clip and extending along the width of the clip.

In the writing implement according to the present invention, the clip may be provided with an auxiliary projection, for supporting the coil spring, formed on the inner surface of the clip opposite to the projection at a position in front of the back wall.

In the writing implement according to the present invention, the inside diameter of the coil spring may be determined so that the projection can be fitted in the coil spring by pressing.

In the writing implement according to the present invention, a back part of the inner surface of the clip may be inclined such that a back part of the clip is tapered toward the back end of the clip.

In the writing implement according to the present invention, the clip may be made of a metal.

In the writing implement according to the present invention, the diameter of the upper end of the projection may be smaller than that of the lower end of the same.

In the writing implement according to the present invention, the projection may be tapered toward the upper end thereof.

In the writing implement according to the present invention, the diameter of the projection may be reduced stepwise toward the upper end thereof.

Thus the writing implement of the present invention is simple in construction, easy to assemble and provided with the highly strong clip capable of preventing the coil spring from easily coming off the clip.

DETAILED DESCRIPTION OF THE INVENTION

Figure 1:
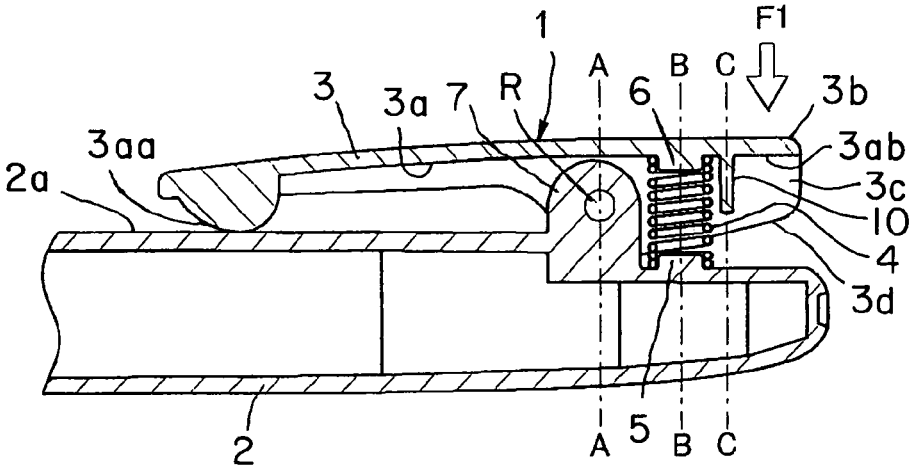
FIG. 1 is a fragmentary longitudinal sectional view of a writing implement in a first embodiment according to the present invention.
Figure 2:
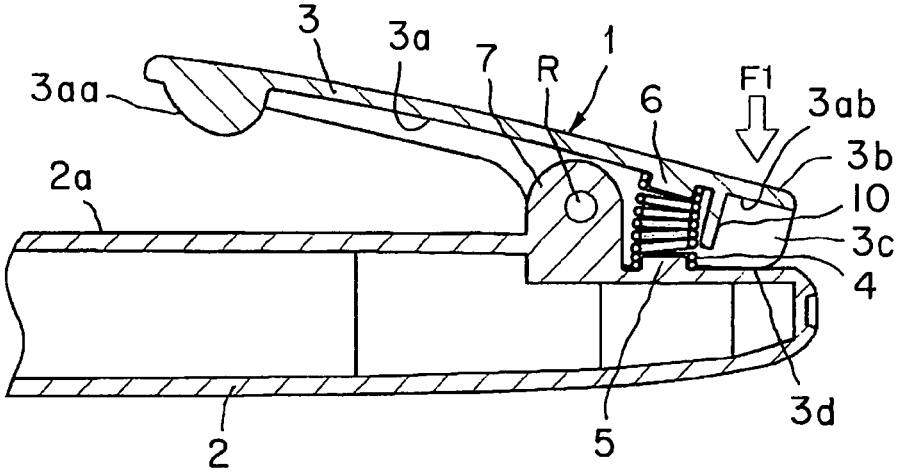
FIG. 2 is a fragmentary longitudinal sectional view, of the writing implement shown in FIG. 1, showing a clip turned to separate the inner surface of the clip from a barrel.
Figure 3:
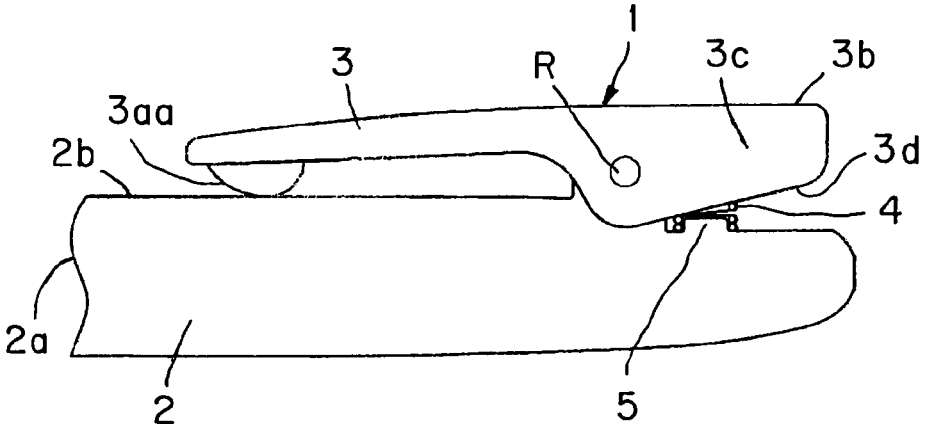
FIG. 3 is a fragmentary, side elevation of the writing implement shown in FIG. 1.

Writing implements with a clip in preferred embodiments according to the present invention will be described with reference to the accompanying drawings. The present invention is not limited in its practical application to the preferred embodiments specifically described herein.

A first embodiment of the present invention will be described with reference to FIGS. 1 to 6.

A writing implement 1 in the first embodiment includes a barrel 2 forming a tubular body, a clip 3, a pillar 7 formed on the outer surface 2*a* of the barrel 2, a connecting structure R connecting the clip 3 and the pillar 7, a coil spring 4 extended between the inner surface 3*a* of the clip 3 and the barrel 2 at a position behind the pillar 7, and a cylindrical projection 5 projecting from the outer surface 2*a* of the barrel 2 toward the clip 3 to support the coil spring 4 thereon. The coil spring 4 loads the clip 3 such that the inner surface 3*a* of a front end part 3*aa* of the clip 3 is pressed elastically against the outer surface 2*a* of the barrel 2 and permits the clip 3 to be turned on the connecting structure R so that the inner surface 3*a* of the front end part 3*aa* of the clip 3 is separated from the barrel 2 when a back end part 3*d* of a back part 3*b* of the clip 3 is pressed toward the barrel 2.

The writing implement 1 has a back wall 10 standing on a back part 3*ab* of the inner surface 3*a* of the clip 3. The coil spring 4 is disposed between the pillar 7 and the back wall 10 near the back wall 10. The coil spring 4 is surrounded by the pillar 7 and the back wall 10.

Preferably, the writing implement 1 has a pair of side walls 3*c* formed in a back part 3*b* of the clip 3. When the pair of side walls 3*c* are formed on the clip 3, the clip 3 has a substantially U-shaped cross section and the coil spring 4 is surrounded by the pair of side walls 3*c*, the pillar 7 and the back wall 10.

The connecting structure R includes connecting projections 8 formed on the pillar 7, and connecting recesses 9 formed in the side walls 3*c*. The connecting projections 8 are fitted in the connecting recesses 9, respectively. Connecting projections and connecting recesses may be formed in the side walls 3*c* and the pillar 7, respectively.

Figure 6:
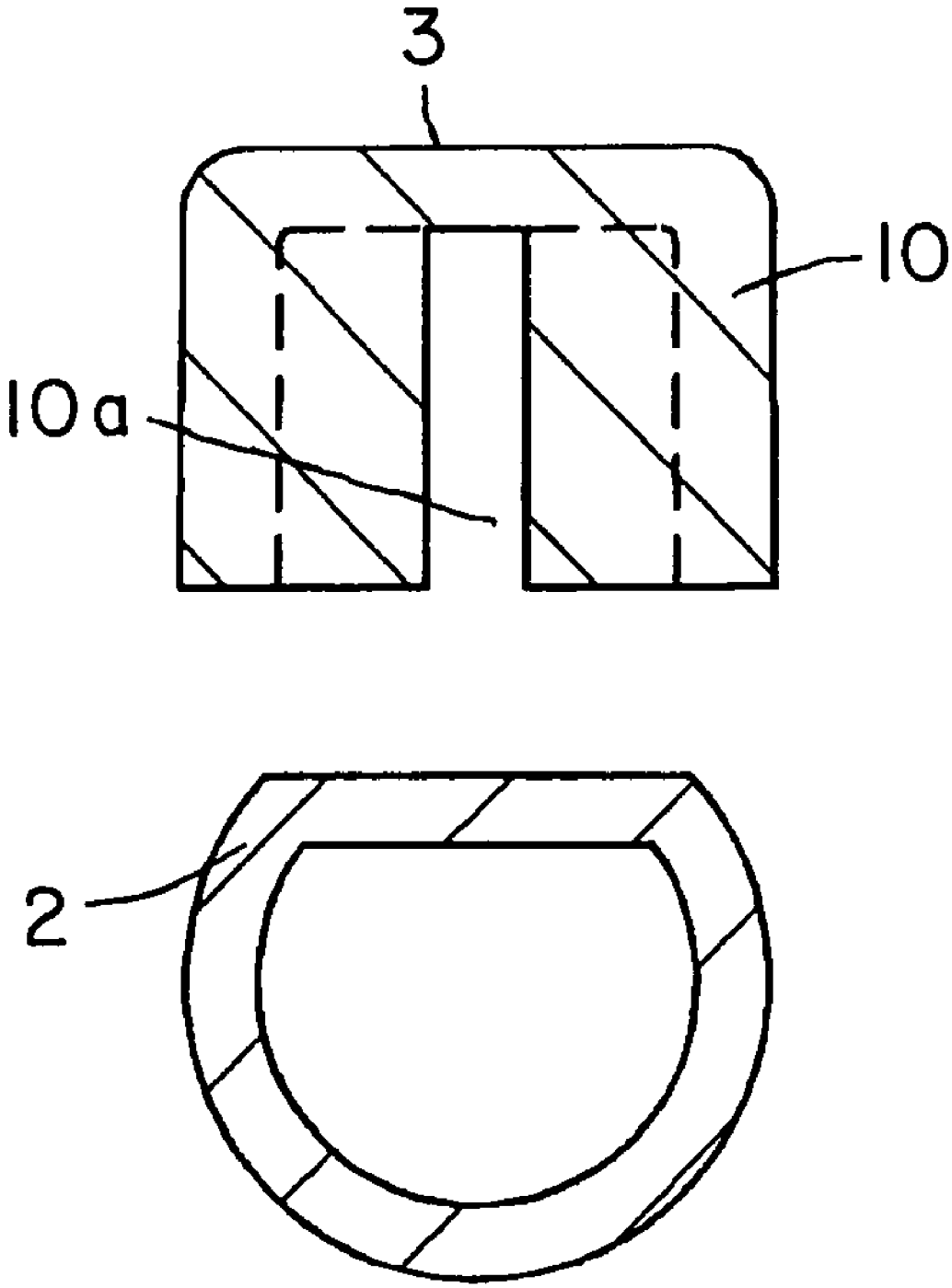
FIG. 6 is an enlarged cross-sectional view taken on the line C-C in FIG. 1.
Figure 7:
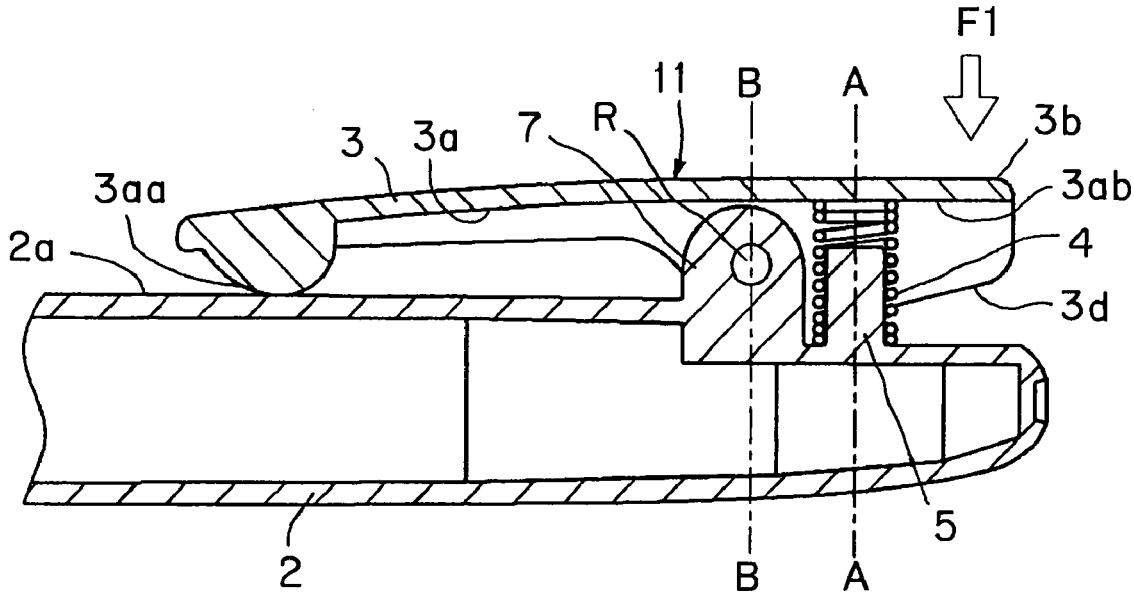
FIG. 7 is a fragmentary, longitudinal sectional view of a writing implement in a second embodiment according to the present invention.

Preferably, the back wall 10 is provided with a slit 10*a* extending in parallel to the side walls 3*c* as shown in FIG. 6.

As shown in FIGS. 1 and 6, the back wall 10 has the shape of a thin plate having a thickness parallel to the length of the clip 3, i.e., parallel to a horizontal direction as viewed in FIG. 1, and extending along the width of the clip 3.

Preferably, the clip 3 is provided with an auxiliary projection 6 disposed opposite to the projection 5 at a position in front of the back wall 10 on a back part 3*ab* of the inner surface 3*a* of the clip 3. The inside diameter of the coil spring 4 is determined so that the projection 5 and the auxiliary projection 6 can be fitted in the coil spring 4 by pressing. The coil spring 4 is put on the projection 5 and the auxiliary projection 6.

The writing implement 1 in the first embodiment is provided with the projection 5 projecting from the outer surface 2*a* of the barrel 2 toward the clip 3, and the coil spring 4 is put on the projection 5. Therefore, the barrel 2 does not need to be provided with any recess in its cylindrical surface, and the writing implement 1 can be easily machined and assembled.

The back wall 10 formed in the back part 3*ab* of the inner surface 3*a* of the clip 3 supports the coil spring 4 laterally when the front end part 3*aa* of the inner surface 3*a* of the clip 3 is separated from the barrel 2 and the coil spring 4 is warped. Thus the coil spring 4 is prevented from easily coming off the barrel 2.

The clip 3 is provided with the pair of side walls 3*c* in its back part 3*b*. Since the coil spring 4 is surrounded on its four sides by the pair of side walls 3*c*, the pillar 7 and the back wall 10, the coil spring 4 can be prevented from easily coming off the barrel 2.

The back part 3*b* of the clip 3 is formed in a substantially U-shaped cross section by forming the pair of side walls 3*c* in the back part 3*b*, and the back wall 10 is formed in the back part 3*b* to reinforce the clip 3. Thus the side walls 3*c* of the clip 3 will not be bent and will not be broken even if an excessive force, such as an impact or an excessively high pressure, is exerted thereon during repetitive operations.

When the pillar 7 is formed integrally with the barrel 2, it is very difficult to form a recess in the outer surface of the barrel 2 simultaneously with pillar 7 when the barrel 2 is formed by molding. Simultaneous formation of the barrel 2, the pillar 7 and the recess cannot be achieved by molding using an ordinary two-part split mold and needs molding using three-part split mold or secondary machining. Thus the use of the projection 5 formed on the outer surface of the barrel 2 for supporting the coil spring 4 is advantageous.

The connecting structure R includes projections 8 formed in the pillar 7 and recesses 9 formed in the side walls 3*c*. The projections 8 engage in the recesses 9, respectively. The connecting structure R is simple in construction and facilitates assembling work.

Figure 4:
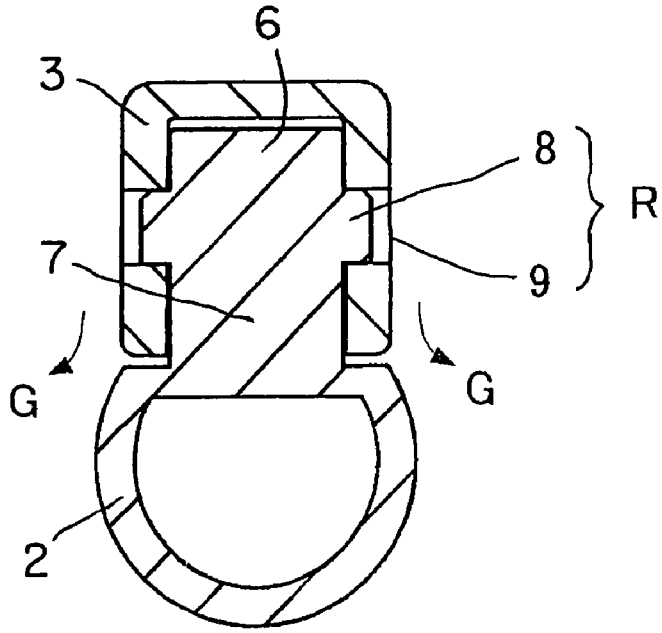
FIG. 4 is an enlarged cross-sectional view taken on the line A-A in FIG. 1.
Figure 5:
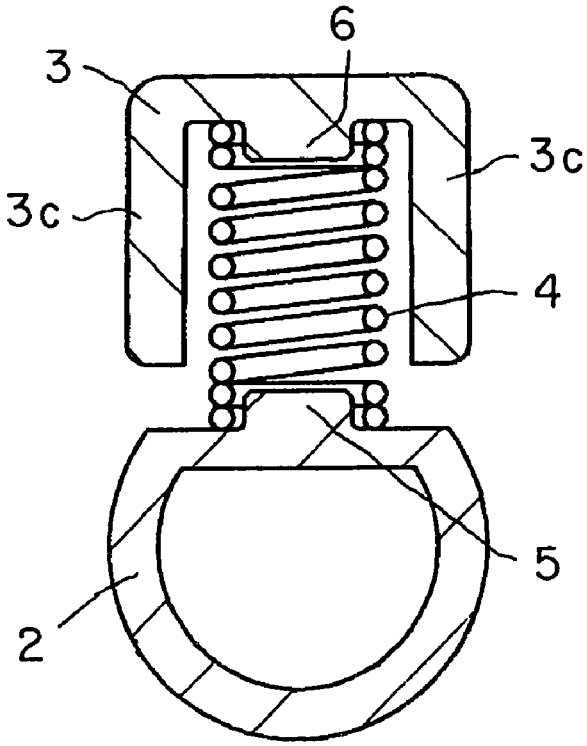
FIG. 5 is an enlarged cross-sectional view taken on the line B-B in FIG. 1.

The connecting structure R needs to exert a sufficient holding force on the clip 3 to restrain the clip 3 from falling off the barrel 2. Therefore, in the connecting structure R, the projections 8 must be fitted in the recesses 9 by a sufficient depth. It is preferable to form the slit 10*a* opening toward the barrel 2 in the back wall 10 so that the reduction of the strength of the clip 3 may be limited to the least possible extent. The slit 10*a* permits bending the side walls 3*c* outward as shown in FIG. 4 to engage the projections 8 in the recesses 9, facilitates assembling work.

The auxiliary projection 6 is disposed opposite to the projection 5 at a position in front of the back wall 10 on the back part 3*ab* of the inner surface 3*a* of the clip 3 and the inside diameter of the coil spring 4 is determined so that the projection 5 and the auxiliary projection 6 can be fitted in the coil spring 4 by pressing. The coil spring 4 put on the projection 5 and the auxiliary projection 6 can be warped and hence the coil spring 4 can be restrained from falling off the barrel 2.

The writing implement 1 with the clip 3 of the present invention does not need any recess for partly receiving the coil spring 4 to prevent the coil spring 4 from falling off. Therefore, the barrel 2 and the clip 3 do not need to have a big wall thickness. Thus increase in the cost of the writing implement 1 can be suppressed, and the degree of freedom of design of the writing implement 1 can be increased. Since the coil spring 4 is extended between the barrel 2 and the clip 3, the writing implement 1 can be easily assembled as compared with the conventional writing implement provided with the coil spring in the barrel. Since a space is not needed for the coil spring 4 in the barrel 2, the present invention can be particularly effectively applied to a writing implement, not shown, provided with an extending and retracting mechanism in a barrel.

A writing implement 11 in a second embodiment according to the present invention will be described with reference to FIGS. 7 to 11. The writing implement 11 in the second embodiment has a projection 5 of a height N.

The height N is not less than half the length n of a coil spring 4 in a state where a front end part 3*aa* of the inner surface 3*a* of a clip 3 is in contact with a barrel 2. In the writing implement 11 shown in FIGS. 1 to 11, the projection 5 has a substantially cylindrical shape. Preferably, the projection 5 has an outside diameter M approximately equal to the inside diameter m of the coil spring 4 and the projection 5 is fitted in the coil spring 4 by pressing to make the coil spring 4 difficult to come off the projection 5.

Figure 8:
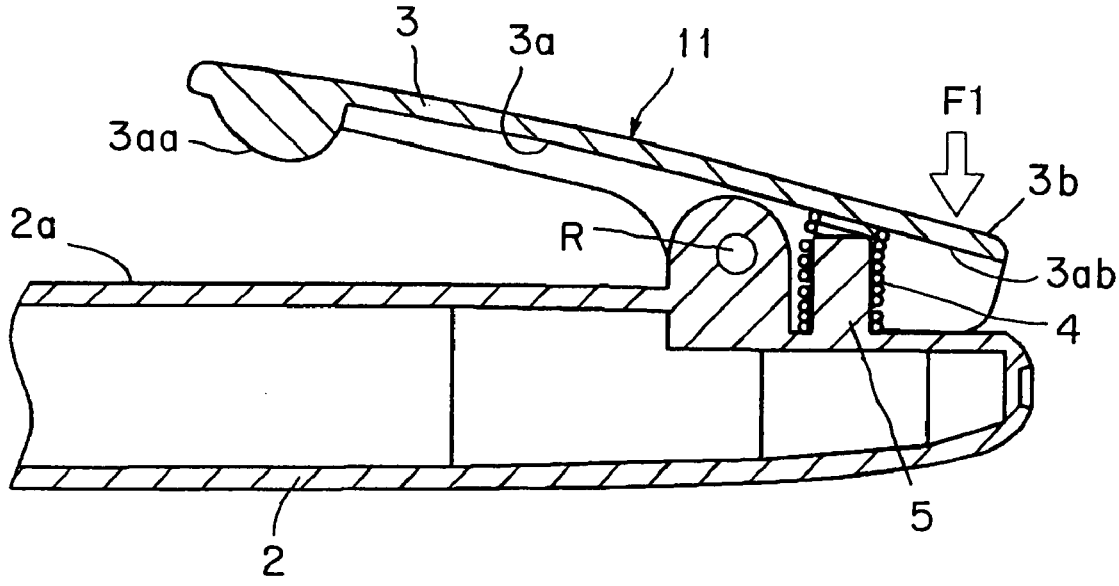
FIG. 8 is a fragmentary longitudinal sectional view, of the writing implement shown in FIG. 7, showing a clip turned to separate the inner surface of the clip from a barrel.
Figure 9:
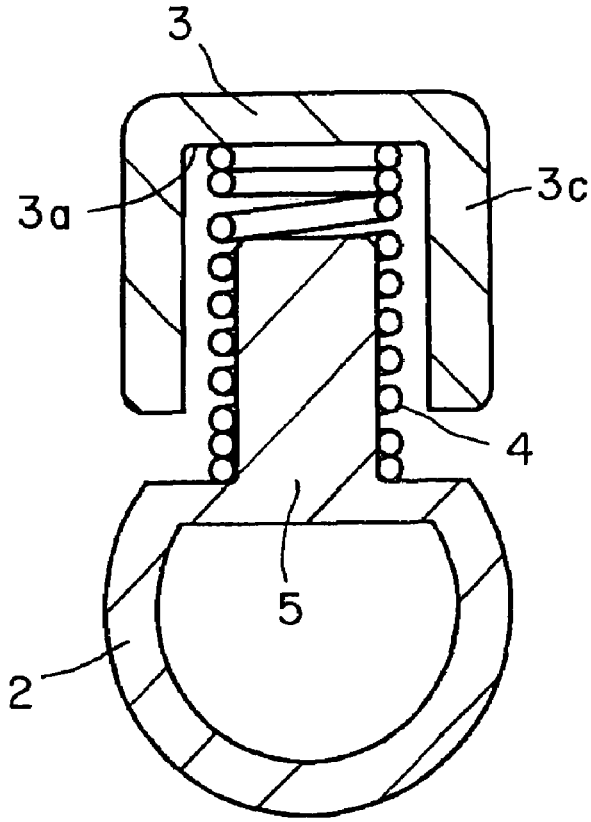
FIG. 9 is an enlarged cross-sectional view taken on the line A-A in FIG. 7.
Figure 10:
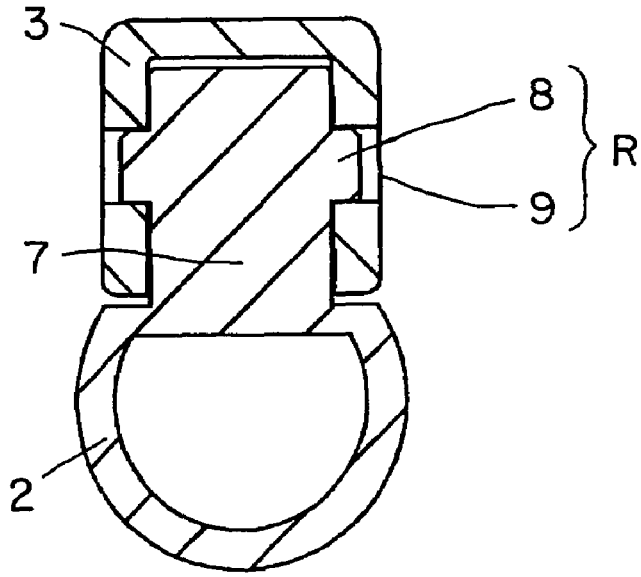
FIG. 10 is an enlarged cross-sectional view taken on the line B-B in FIG. 7.
Figure 11:
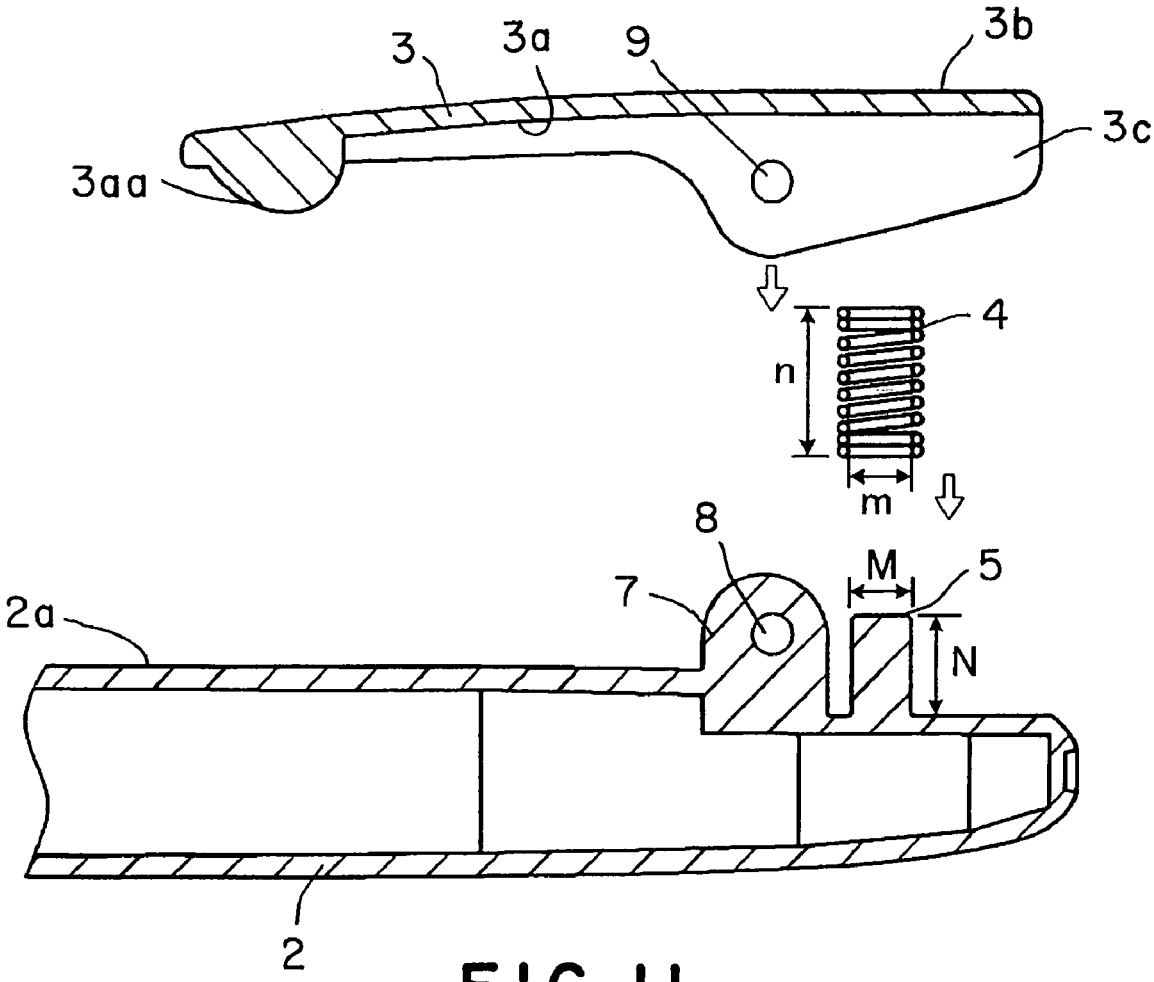
FIG. 11 is an exploded sectional view of the writing implement shown in FIG. 7.

Since the height N of the projection 5 is not less than half the length n of the coil spring 4, the projection 5 is pressed into a part of the coil spring of a length more than half the length of the coil spring 4. Therefore, even if the coil spring 4 is warped as shown in FIG. 8, the coil spring 4 will not easily fall off the barrel 2.

Since the coil spring 4, namely, the elastic member, has a laterally symmetrical shape, the coil spring 4 does not need to be disposed in a special direction. Thus the coil spring 4 does not complicate assembling work and facilitates assembling work. Even if the coil spring 4 is compressed repeatedly by repeating an operation for separating the front end part 3*aa* of the inner surface 3*a* of the clip 3 from the outer surface 2*a* of the barrel 2, the coil spring 4 held by the projection is resistant to deformation and hence the resilience of the coil spring 4 for pressing the front end part 3*aa* of the inner surface 3*a* of the clip 3 against the outer surface of the barrel 2 will not change.

The projection 5 of the height H not less than half the length n of the coil spring 4 is capable of stably holding the coil spring 4 even though the writing implement 11 does not have any auxiliary projection corresponding to the auxiliary projection 6 formed on the clip 3 shown in FIG. 1.

There is not any particular restriction on the material of the clip 3 of the writing implement 11 in the second embodiment and the clip 3 may be made of a resin or a metal. The clip 3 of a metal can be easily made. Generally, it is difficult to form a projection of a recess for holding the coil spring 4 on the inner surface of the clip 3 if the clip 3 is made of a metal. Since the clip 3 of the writing implement 11 does not need to be provided with any projection corresponding to the auxiliary projection 6 on the inner surface 3*a*, the inner surface 3*a* of the clip 3 may be substantially flat. Thus the clip 3 can be easily made of a metal.

Since the coil spring 4 is extended between the barrel 2 and the clip 3 in the writing implement 11, the writing implement 11 can be easily assembled as compared with the conventional writing implement in which the coil spring is engaged in the recess formed in the barrel. Since a space is not needed for the coil spring 4 in the barrel 2, the present invention can be particularly effectively applied to a writing implement, not shown, provided with an extending and retracting mechanism in a barrel A writing implement 11 in a modification of the writing implement 11 shown in FIGS. 7 to 11 will be described with reference to FIGS. 12 and 13.

Figure 12:
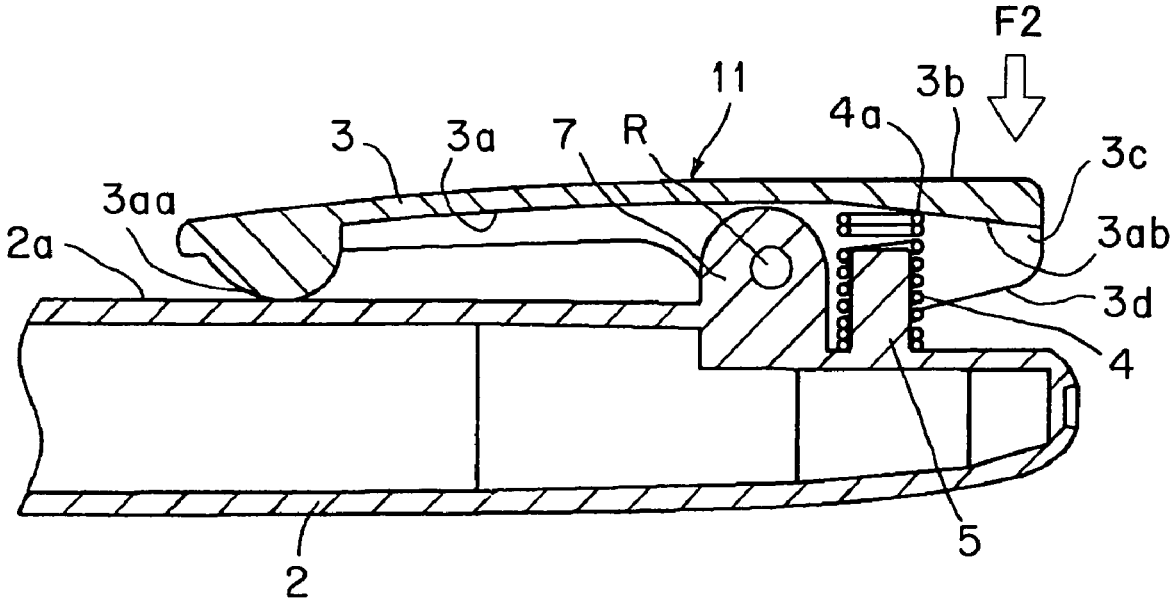
FIG. 12 is a fragmentary longitudinal sectional view of a writing implement in a modification of the writing implement shown in FIG. 7.
Figure 13:
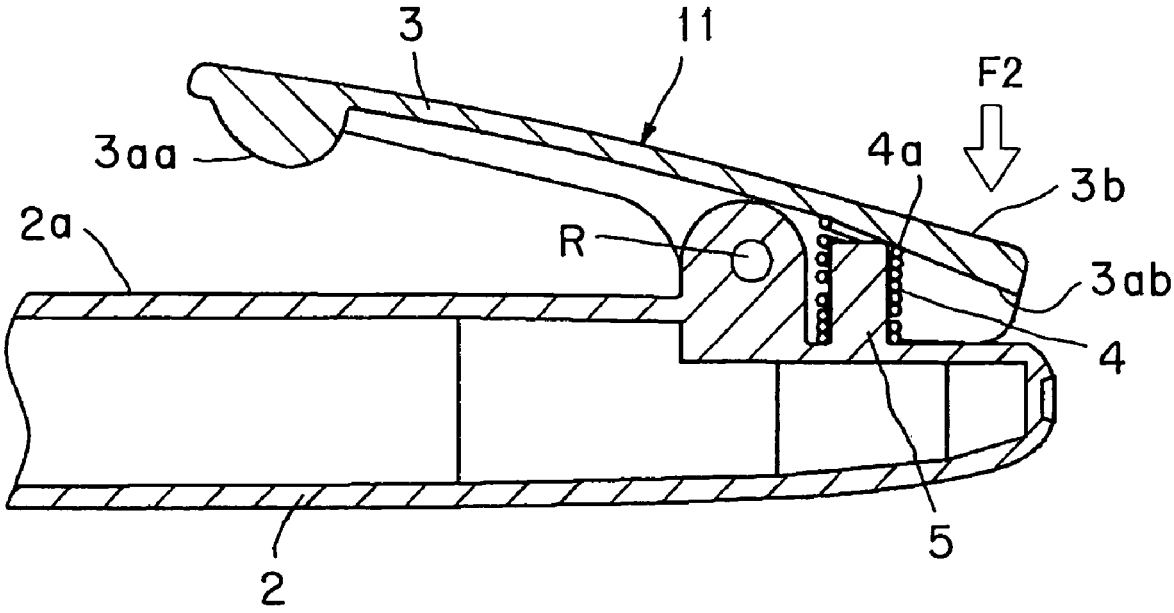
FIG. 13 is a fragmentary longitudinal sectional view, of the writing implement shown in FIG. 12, showing a clip turned to separate the inner surface of the clip from a barrel.
Figure 14:
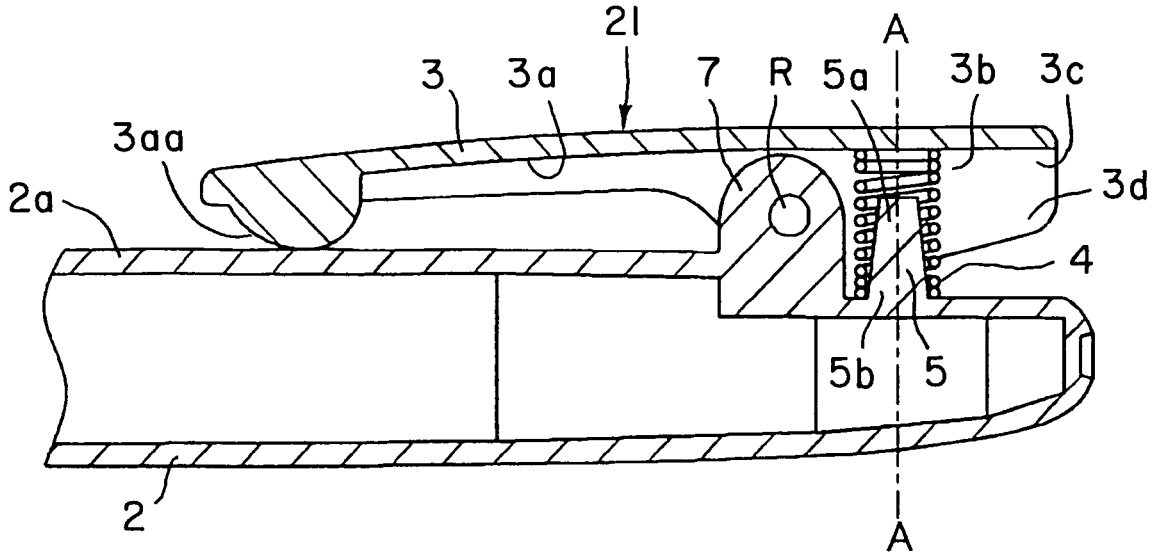
FIG. 14 is a fragmentary longitudinal sectional view of a writing implement in a third embodiment according to the present invention.
Figure 15:
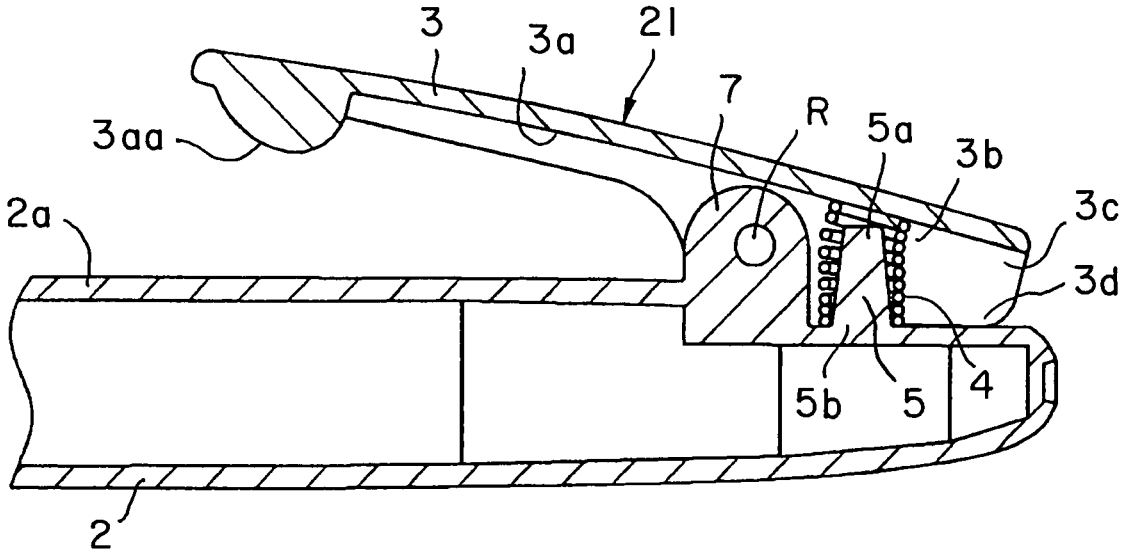
FIG. 15 is a fragmentary longitudinal sectional view, of the writing implement shown in FIG. 14, showing a clip turned to separate the inner surface of the clip from a barrel.
Figure 16:
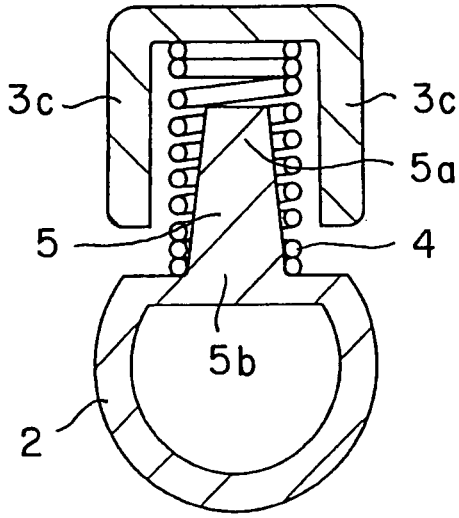
FIG. 16 is an enlarged cross-sectional view taken on the line A-A in FIG. 14.
Figure 17:
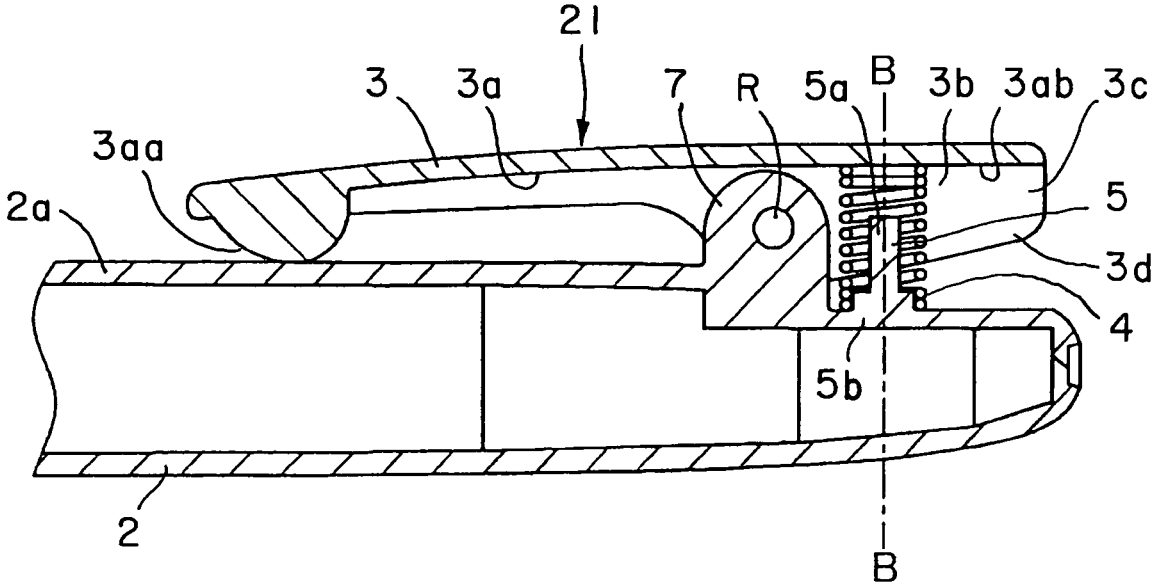
FIG. 17 is a fragmentary longitudinal sectional view of a writing implement in a modification of the writing implement shown in FIG. 14.
Figure 18:
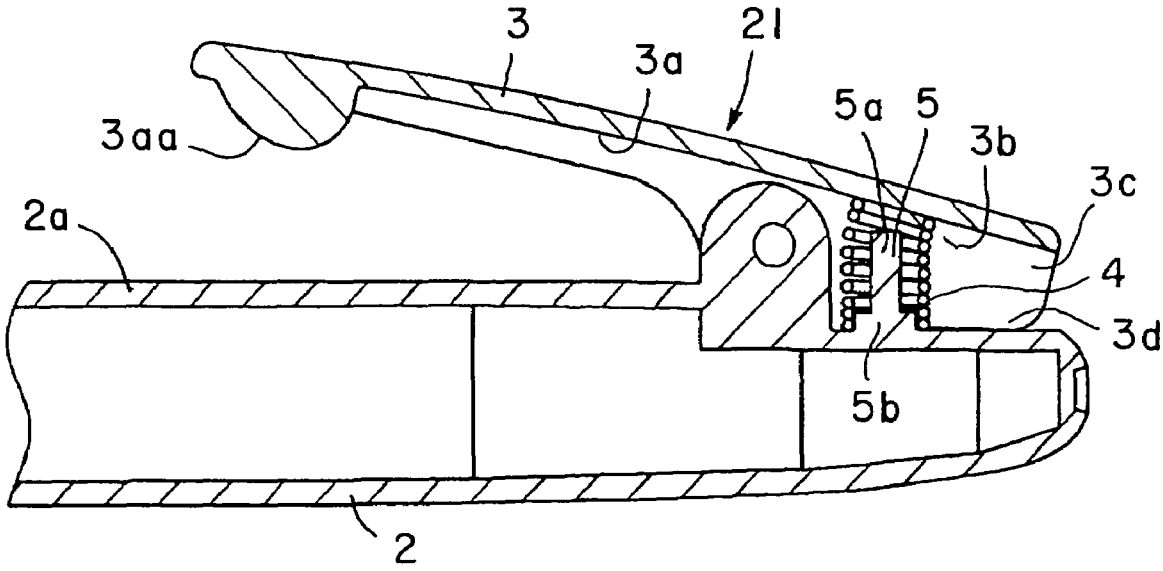
FIG. 18 is a fragmentary longitudinal sectional view, of the writing implement shown in FIG. 17, showing a clip turned to separate the inner surface of the clip from a barrel.
Figure 19:
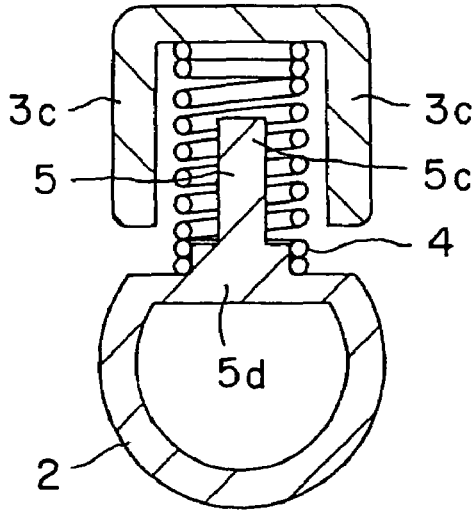
FIG. 19 is an enlarged cross-sectional view taken on the line B-B in FIG. 17.

The writing implement 11 shown in FIGS. 12 and 13 is the same as the writing implement 11 shown in FIGS. 7 to 11, except that the former has a clip 3 different from that of the latter. As shown in FIGS. 12 and 13, a back part 3*ab* of the inner surface 3*a* of the clip 3 extends obliquely downward toward the back end part 3*d*.

Since the back part 3*ab* of the inner surface 3*a* of the clip 3 extends obliquely downward toward the back end part 3*d*, the back part 3*ab* of the inner surface 3*a* of the clip 3 can surely come into contact with a back part 4*a* of the top coil of the coil spring 4 when the clip 3 is turned to separate the front end part 3*aa* of the inner surface 3*a* of the clip 3 from the outer surface 2*a* of the barrel 2. Consequently, the back part 3*ab* of the inner surface 3*a* of the clip 3 comes into close contact with the top coil of the coil spring 4. Thus the resilient force of the coil spring 4 can be stably applied to the back part 3*ab* of the inner surface 3*a* of the clip 3 in a direction opposite the direction of the arrow F2 shown in FIGS. 12 and 13.

When the back part 3*ab* of the inner surface 3*a* of the clip 3 extends obliquely downward toward the back end part 3*d*, the compression of the coil spring 4 increases and coil spring 4 may become likely to come off the projection 5. However, the projection 5 of the height N not less than half the length n of the coil spring 4 can prevent the coil spring 4 from coming off the projection 5 with reliability.

A writing implement 21 in a third embodiment according to the present invention will be described with reference to FIGS. 14 to 19, in which parts like or corresponding to those of the first and the second embodiment will be denoted by the same reference characters and the description thereof will be omitted.

The writing implement 21 has a projection 5. The diameter of an upper part 5*a* of the projection 5 is smaller than that of a lower part 5*b* of the same. The lower end of the lower part 5*b* has a diameter approximately equal to the inside diameter of a coil spring 4.

The projection 5 having the upper part 5*a* of a diameter smaller than that of the lower part 5*b* can be formed in any one of various shapes. A projection 5 shown in FIGS. 13 to 16 is tapered toward the upper end thereof. A projection 5 shown in FIGS. 17 to 19 has a cylindrical lower part 5*b* of a diameter approximately equal to the inside diameter of a coil spring 4 and a cylindrical upper part 5*a* of a diameter smaller than the inside diameter of the coil spring 4. Another possible projection, not shown, may have a cylindrical lower part 5*b* of a diameter approximately equal to the inside diameter of the coil spring 4 and a semispherical upper part 5*a*.

When the clip 3 is turned to separate the front end part 3*aa* of the inner surface 3*a* of the clip 3 from the outer surface 2*a* of the barrel 2, an upper part of the warped coil spring 4 can come into contact with an upper part 5*a* of the projection 5*a* more smoothly than a coil spring 4 put on a cylindrical projection 5 of a uniform diameter because the diameter of the upper part 5*a* of the projection 5 is smaller than that of the lower part 5*b* of the same. Consequently, the clip 3 can be turned smoothly to separate the front end part 3*aa* of the inner surface 3*a* of the clip 3 from the outer surface 2*a* of the barrel 2.

Although the description of the foregoing embodiments has been made on an assumption that the tubular body includes only the barrel 2, the tubular body may include a barrel 2 and a cap, and the clip 3 may be attached to the cap. Although the connecting structure for connecting the clip and the barrel in the foregoing embodiments includes the openings formed in the side walls of the clip and the projections formed in the barrel so as to correspond to the openings of the clip, the connecting structure may be any type provided that the clip can be turned on the connecting structure connecting the clip and the tubular body to separate the front end part of the inner surface of the clip from the barrel. For example, the connecting structure may include spherical protrusions formed in the tubular body (or the clip) and recesses formed in the clip (or the tubular body) so as to correspond to the spherical protrusions.

INDUSTRIAL APPLICABILITY

The present invention is applicable to a wide variety of writing implements regardless of types of inks including low-viscosity inks, shear thinning inks and water-base inks, regardless of the shape and material of writing tips and regardless of types of writing implement including push-button types and capped types.

The invention claimed is:

1. A writing implement comprising:

a tubular body having a barrel;

a clip;

a pillar formed on an outer surface of the tubular body;

a connecting structure connecting the clip and the pillar;

a compressed coil spring extended between an inner surface of the clip and the tubular body, the compressed coil spring being capable of loading the clip such that a front end part of the inner surface of the clip is pressed elastically against the outer surface of the tubular body and of permitting the clip to be turned on the connecting structure so that the front end part of the inner surface of the clip is separated from the barrel when a back end part of the clip is pressed toward the tubular body; and a projection formed on the outer surface of the tubular body at a position behind the pillar so as to project from the outer surface of the tubular body toward the clip and to support the compressed coil spring thereon, wherein the clip is provided with a back wall inside a back part thereof, and the compressed coil spring is disposed on a front side of the back wall.

2. The writing implement according to claim 1, wherein the clip is provided with side walls in the back part thereof, and the compressed coil spring is disposed between the side walls.

3. The writing implement according to claim 2, wherein the connecting structure has projections formed in the side walls, and recesses formed in the pillar so as to receive the projections.

4. The writing implement according to claim 2, wherein the connecting structure has projections formed in the pillar, and recesses formed in the side walls so as to receive the projections.

5. The writing implement according to claim 1, wherein the back wall is provided with a slit.

6. The writing implement according to claim 1, wherein the back wall has the shape of a thin plate having a thickness parallel to the length of the clip and extending along the width of the clip.

7. The writing implement according to claim 1, wherein the clip is provided with a back wall inside a back part thereof, and wherein the clip is provided with an auxiliary projection, for supporting the compressed coil spring, formed on the inner surface of the clip opposite to the projection at a position in front of the back wall.

8. The writing implement according to claim 1, wherein the inside diameter of the compressed coil spring is determined so that the projection can be fitted in the coil spring by pressing.

9. A writing implement comprising:

a tubular body having a barrel;

a clip;

a pillar formed on an outer surface of the tubular body;

a connecting structure connecting the clip and the pillar;

a compressed coil spring extended between an inner surface of the clip and the tubular body, the compressed coil spring being capable of loading the clip such that a front end part of the inner surface of the clip is pressed elastically against the outer surface of the tubular body and of permitting the clip to be turned on the connecting structure so that the front end part of the inner surface of the clip is separated from the barrel when a back end part of the clip is pressed toward the tubular body; and a projection formed on the outer surface of the tubular body at a position behind the pillar so as to project from the outer surface of the tubular body toward the clip and to support the compressed coil spring thereon, wherein the projection has a height not smaller than half the length of the compressed coil spring in a state for loading the clip to keep the front end part of the inner surface of the clip in contact with the barrel.

10. The writing implement according to claim 9, wherein a back part of the inner surface of the clip is inclined such that a back part of the clip is tapered toward a back end of the clip.

11. The writing implement according to claim 9, wherein the clip is made of a metal.

12. The writing implement according to claim 9, wherein the diameter of an upper end of the projection is smaller than that of a lower end of the same.

13. The writing implement according to claim 12, wherein the projection is tapered toward the upper end thereof.

14. The writing implement according to claim 12, wherein the diameter of the projection is reduced stepwise toward the upper end thereof.

15. The writing implement according to claim 9, wherein the clip is provided with side walls in a back part thereof, and the compressed coil spring is disposed between the side walls.

16. The writing implement according to claim 15, wherein the connecting structure has projections formed in the pillar, and recesses formed in the side walls so as to receive the projections.

17. The writing implement according to claim 15, wherein the connecting structure has projections formed in the side walls, and recesses formed in the pillar so as to receive the projections.

* * * * *